United States Patent [19]

Kruse et al.

[11] Patent Number: 4,642,197

[45] Date of Patent: Feb. 10, 1987

[54] PROCESS FOR THE PRODUCTION OF A WASHING ADDITIVE IN TABLET FORM

[75] Inventors: Hans Kruse, Korschenbroich; Klaus Koester, Langenfeld; Franz-Josef Carduck, Haan; Heinz-Manfred Wilsberg, Cologne; Rolf Puchta, Haan, all of Fed. Rep. of Germany

[73] Assignee: Henkel Kommanditgesellschaft auf Aktien, Duesseldorf, Fed. Rep. of Germany

[21] Appl. No.: 733,669

[22] Filed: May 13, 1985

[30] Foreign Application Priority Data

May 14, 1984 [DE] Fed. Rep. of Germany ..... 3417820

[51] Int. Cl.[4] ..... C11D 17/00

[52] U.S. Cl. ..... 252/98; 252/91; 252/92; 252/94; 252/102; 252/174; 252/174.16; 252/543; 252/547; 252/186.2; 252/186.25; 252/DIG. 16; 252/DIG. 17

[58] Field of Search ..... 252/90, 91, 94, 154, 252/174.13, 174.16, 174, 541, 543, 547, 186.2, 186.25, DIG. 16, DIG. 17

[56] References Cited

U.S. PATENT DOCUMENTS

| | | | |
|---|---|---|---|
| 3,789,002 | 1/1974 | Weber et al. | 252/186.25 |
| 4,220,562 | 9/1980 | Spadini et al. | 252/542 |
| 4,290,903 | 9/1981 | Macgilp et al. | 252/91 |
| 4,444,674 | 4/1984 | Gray | 252/91 |

FOREIGN PATENT DOCUMENTS

| | | |
|---|---|---|
| 0000226 | 1/1979 | European Pat. Off. . |
| 2535183 | 4/1976 | Fed. Rep. of Germany . |
| 2857153 | 1/1980 | Fed. Rep. of Germany . |
| 1423536 | 2/1976 | United Kingdom . |

OTHER PUBLICATIONS

European Search Report EP 85 10 5496.

*Primary Examiner*—Paul Lieberman
*Assistant Examiner*—Hoa Van Le
*Attorney, Agent, or Firm*—Ernest G. Szoke; Henry E. Millson, Jr.

[57] ABSTRACT

A powdery activator for per compounds is granulated by, at the same time, mixing it together with nonionic surface-active compounds certain nitrogen-containing compounds and, optionally, the water-soluble salt of an alkane polyphosphonic acid. The granulate thus obtained is powdered with a powdery absorbent and the powdered granulate is sprayed with a liquid binder and dried to a water content of at most 6% by weight. After the addition of a tablet disintegrating agent, the dried granulate is formed by compression under special conditions into tablets having special properties. When added to a wash liquor containing a standard detergent containing a per compound, the tablets improve the removal of fatty/oily stains, pigment-containing soil and bleachable stains.

15 Claims, No Drawings

PROCESS FOR THE PRODUCTION OF A WASHING ADDITIVE IN TABLET FORM

BACKGROUND OF THE INVENTION

This invention relates to a process for the production of a washing additive containing active ingredients for improving the removability by washing of bleachable stains, fatty or oily stains and pigment-containing soil, the washing additive being obtained in the form of a tablet in its production by the process according to the invention. When added to a wash liquor containing a standard detergent containing a per compound, the use of the tablets improve the removal of fatty/oily stains, pigment-containing soil and bleachable stains from the laundry.

Washing additives in tablet form have long been known as wash-active ingredients, they often contain a bleach activator for per compounds either on its own or in combination with other active ingredients and standard tabletting aids. One such product is described, for example, in Great Britain Pat. No. 1,423,536. In conjunction with the per compounds normally present in modern universal detergents, bleach activators improve the removal of bleachable stains. Although, in general, the detergents also contain bleach activators in addition to per compounds, difficulties frequently arise during the storage of detergents containing both per compounds and activators as a result of the fact that the bleach activator acts prematurely on the per compounds so that the per compounds lose some of their effectiveness. In the washing of heavily soiled clothing, such as working clothes for example, importance is attached not only to the satisfactory removal of bleachable stains, but also to the removal of fatty or oily stains and pigment-containing soil. Accordingly, washing additives which, in addition to a bleach activator, also contain nonionic surface-active compounds (or tensides), certain quaternary ammonium compounds to boost detergency and, optionally, organic phosphonic acid derivatives have also been described with a view to improving the removal of the various types of stains mentioned above (cf. DE-OS No. 28 57 153). This German published application relates to washing additives in which the above-mentioned combination of active ingredients is applied to a flexible carrier. For washing, the carrier charged with active ingredients is introduced with the laundry into the washing machine where it develops its effect during the washing process. On completion of washing, the flexible carrier for the active ingredients remains in the laundry and has to be separated therefrom.

Washing additives in tablet form are frequently sensitive to mechanical stressing and crumble before using or do not dissolve completely or quickly enough if the composition and production of the tablets are designed to provide the tablets with adequate mechanical stability.

OBJECTS OF THE INVENTION

An object of the present invention is to provide a process for producing a washing additive in tablet form, in which an activator for per compounds, detergency improves, and standard tabletting aids are mixed together and the resulting mixture converted into tablets of good mechanical stability.

A further object of the present invention is the development of a process for the production of a washing additive in tablet form containing (1) at least one activator for per compounds, (2) at least one nonionic surface-active compound, (3) at least one surface-active nitrogen-containing compound selected from the group consisting of quaternary ammonium compounds, fatty amine compounds, aminopropionic acid compounds and mixtures thereof, (4) optionally at least one water-soluble salt of an alkane polyphosphonic acid, and (5) optionally at least one foam regulator, as wash-active ingredients, in which said activator for per compounds and standard tabletting aids are mixed together and the resulting mixture is tabletted, consisting essentially in that the powdery activator for per compounds is granulated by, at the same time, mixing together with said nonionic surface-active compounds, said surface-active nitrogen-containing compound the tabletting aids and optionally, said water-soluble salt of an alkane polyphosphonic acid, and, optionally, said foam regulator, the granulate is powdered with a powdery adsorbent and the powdered granulate is sprayed with a liquid binder and then dried to a water content of at most 6% by weight, said dried granulate is mixed with at least one tablet disintegrating agent, and the mixture is formed by compression into tablets of which the shape, weight and density are selected in such a way that the tablets contain sufficient detergency-boosting ingredients for one load of washing and are circulated by the pieces of laundry during the washing process so that they dissolve quickly and completely.

These and other objects of the invention will become more apparent as the description thereof proceeds.

DESCRIPTION OF THE INVENTION

The invention relates to a process for the production of a washing additive in tablet form. The washing additive produced according to the process of the invention is intended to contain the desired wash-active ingredients in quantitative ratios adapted to one another and in a quantity adapted to the load capacity of a washing machine and not to have to be separated from the laundry after washing. In addition, the washing additive produced according to the process of the invention in tablet form is intended to be so stable that it can be conveniently handled. In addition, it is intended to dissolve quickly and completely in the wash liquor.

According to the invention, this object is achieved by granulating and, at the same time, mixing the powdery activator for per compounds together with nonionic tensides, with surface-active nitrogen-containing compounds selected from the group consisting of quaternary ammonium compounds, fatty amine compounds and aminopropionic acid compounds, with the tabletting aids and, optionally, with the water-soluble salt of an alkane polyphosphonic acid, and optionally, with a foam regulator. The granulate obtained is powdered with a powdery adsorbent, sprayed with a liquid binder and subsequently dried to a water content of at most 6% by weight.

The dried granulate, after the addition of a tablet disintegrating agent, is formed by compression into tablets of which the shape, weight and density are selected in such a way that the tablets contain sufficient detergency-boosting ingredients for one load of washing and are circulated by the pieces of laundry during the washing process so that they dissolve quickly and completely.

More particularly, the invention involves a process for the production of a washing additive in tablet form containing (1) at least one activator for per compounds, (2) at least one nonionic surface-active compound, (3) at least one surface-active nitrogen-containing compound selected from the group consisting of quaternary ammonium compounds, fatty amine compounds, aminopropionic acid compounds and mixtures thereof, (4) optionally at least one water-soluble salt of an alkane polyphosphonic acid, and (5) optionally at least one foam regulator, as wash-active ingredients, in which said activator for per compounds and standard tabletting aids are mixed together and the resulting mixture is tabletted, consisting essentially in that the powdery activator for per compounds is granulated by at the same time, mixing it together with said nonionic surface-active compounds, said surface-active nitrogen-containing compound the tabletting aids and, optionally, said water-soluble salt of an alkane polyphosphonic acid, and, optionally, said foam regulator, the granulate is powdered with a powdery adsorbent and powdered granulate is sprayed with a liquid binder and then dried to a water content of at most 6% by weight, said dried granulate is mixed with at least one tablet disintegrating agent, and the mixture is formed by compression into tablets of which the shape, weight and density are selected in such a way that the tablets contain sufficient detergency-boosting ingredients for one load of washing and are circulated by the pieces of laundry during the washing process so that they dissolve quickly and completely.

The features of the process according to the invention ensure that, on the one hand, the tablet is stable enough nor to disintegrate before it is used in the washing machine. On the other hand, washing additives produced in accordance with the invention dissolve sufficiently rapidly and safely in the washing machine. The features of the process according to the invention also ensure that the tablets obtained can be stored satisfactorily over prolonged periods, even in the damp atmosphere of a laundry room. In addition, the effect of powdering the granulate and spraying it with a liquid binder is that the surface of the granulate containing the active ingredients is largely or completely covered.

In the production of the washing additive in accordance with the invention, a granulate containing the active ingredients is initially prepared. This granulate may also contain a water-soluble or water-insoluble powdery carrier for the liquid or pasty active ingredients and, optionally, a granulate disintegrating agent. Accordingly, this granulate thus contains all the active ingredients and, in addition, auxiliaries which enable it to be safely produced and handled.

The granulate may be produced by known granulation techniques, for example in a mixer or in a fluidized bed. A mixer of the type made by the Loedige Company of Paderborn, Federal Republic of Germany, has been successfully used in practice. In a mixer of this type, the liquid or dissolved or melted active ingredients and auxiliaries are preferably sprayed onto the powdery active ingredients and auxiliaries. A granulate is formed which contains all the active ingredients, which will be discussed in more detail hereinafter, and certain auxiliaries, such as for example carriers for liquid constituents and/or from 1 to 5% by weight of a granulate disintegrating agent, based on the granulate without its protective coating. The addition of a granulate disintegrating agent provides for more rapid disintegration of the granulate particles in the wash liquor and is therefore preferred. In many cases, mixing for up to 30 seconds after formation of the granulate is advisable. Mixing for longer than at most 30 seconds, however, frequently leads to dough-like products.

The final granulate, which should be free or substantially free from fines, is then powdered with a finely-divided inert material and/or a finely divided adsorbent, for example highly disperse silica and/or starch, for example potato starch, and subsequently sprayed with a liquid binder, for example a sugar solution. In this way, the granulate containing the wash-active ingredients is coated with a protective layer of powder and binder. After drying, this coated granulate is largely or completely sealed. Drying of the granulate thus treated to a water content of at most 6% by weight is necessary to keep the granulate free flowing, i.e. to enable it to be delivered without interruption to the tabletting molds. Drying is also necessary to prevent sticking to the tabletting molds and also to ensure that the tablets obtained are readily soluble, even after storage. Drying is best carried out, for example, in a fluidized bed at a maximum air temperature of 90° C.

At least one tablet disintegrating agent is then added to the dryed granulate, combinations of two different tablet disintegrating agents having proved to be particularly effective in practice. The addition of the at least one tablet disintegrating agent ensures rapid disintegration of the tablet into the granulate when the tablet comes into contact with the wash liquor. After mixing with tablet disintegrating agents, the resulting mixture is formed by compression into tablets. The tabletting molds are best polished to prevent sticking. However, it is of advantage to use tabletting molds provided with a non-stick coating. The tabletting conditions and composition of the tablets guarantee the mechanical stability on the one hand and rapid disintegration of the tablets in use on the other hand.

The tablet, the end product of the process according to the invention, contains, as wash-active ingredients, a mixture of at least one activator for per compounds, at least one nonionic tenside, at least one surface-active nitrogen-containing compound, which is optionally granulated with an aqueous solution of at least one water-soluble salt of an alkane polyphosphonic acid and, optionally, at least one foam regulator. The present invention also relates to the production of the granulate containing the above-mentioned active ingredients.

More particularly, the wash-active ingredients are present in the tablet produced according to the invention in an amount of from 50 to 90% by weight and the amounts of the wash-active ingredients are selected such that the tablet contains from 2 to 30% by weight of the activator for per compounds, from 2 to 30% by weight of the nonionic surface-active compound, from 0.5 to 20% by weight of the surface-active nitrogen-containing compounds, from 0 to 5% by weight of the water-soluble salt of an alkane polyphosphonic acid and from 0 to 5% by weight of the foam regulator.

Suitable activators for per compounds are N-acyl or O-acyl compounds. Acetyl compounds have proved to be particularly effective in practice. Examples of suitable acetyl compounds are tetraacetyl glycoluril or pentaacetyl glucose or, more particularly, tetraacetyl ethylenediamine. In conjunction with per compounds of the type normally used in universal detergents and more especially in conjunction with the perborate normally used, the above-mentioned bleach activators improve the removal of bleachable fabric stains.

Suitable nonionic surface-active compounds (or tensides) are, above all, adducts of ethylene oxide onto fatty alcohols containing from 12 to 18 carbon atoms or, more particularly, oxoalcohols containing from 12 to 18 preferably from 14 to 15 carbon atoms. The best results are obtained with oxoalcohol ethoxylates containing from 3 to 10, preferably from 6 to 8 and, more preferably, approximately 7 mols of ethylene oxide per mol of alcohol. The presence in the wash-active additives according to the invention of nonionic surfactants promotes above all the removal of fatty or oily stains during washing.

In many cases, it is best to add foam regulators. Foaming generally has to be suppressed. Suitable foam inhibitors are, for example, the known silicone oils.

The improvement in the removal of pigment-containing soil from fabrics is brought about by the presence in the wash-active additives according to the invention of certain surface-active nitrogen-containing compounds, for example quaternary ammonium compounds and/or fatty amine compounds and/or aminopropionic acid compounds corresponding to the formula R—NH—$CH_2$—$CH_2$—COONa, where R represents a radical having from 10 to 20 carbon atoms selected from the group consisting of alkyl, alkenyl and mixtures thereof. Suitable surface-active quaternary ammonium compounds preferably contain alkyl groups containing from 10 to 16 and, more particularly, approximately 14 carbon atoms as the long-chain $C_{10}$–$C_{20}$ alkyl or alkenyl radical. For the rest, suitable quaternary ammonium compounds contain three identical or different $C_1$–$C_4$ alkyl groups. These short-chain alkyl groups are, in particular, methyl groups. One particularly suitable and, therefore, preferred surface-active quaternary ammonium compound is tetradecyl trimethylammonium bromide. The quaternary ammonium compound may be completely or partly replaced by one or more surface-active fatty amine compounds.

Advantageously the fatty amine compounds are fatty amine lower alkoxylates, preferably fatty amine ethoxylates derived from $C_{10}$–$C_{20}$ fatty amines. These compounds are preferably adducts of from 1 to 6 mols of ethylene oxide with 1 mol of a primary fatty amine containing a long-chain ($C_{10}$–$C_{16}$) alkyl or alkenyl radical. One example of a particularly suitable fatty amine ethoxylate is the adduct of 2 mols of ethylene oxide onto primary cocosalkyl amine, where cocosalkyl is an alkyl-/alkenyl mixture derived from coconut oil fatty acids. Accordingly, this product is also preferred. Instead of or together with the quaternary ammonium compound and the fatty amine compound, it is also possible to use a compound of the formula R—NH—$CH_2$—$CH_2$—COONa, where R is an alkyl or alkenyl radical containing from 10 to 20 carbon atoms, more especially 12 to 14 carbon atoms. A compound in which R is a cocosalkyl residue is preferably used.

For complexing troublesome heavy metal ions, the wash-active additive best contains small quantities of chelating agents. Particularly suitable chelating agents are water-soluble salts of alkane polyphosphonic acids from the group comprising phosphonoalkane polycarboxylic acids and amino- and hydroxy-substituted alkane polyphosphonic acids, more especially the alkali metal salts of amino-tris-(methylene-phosphonic acid), dimethylene aminomethane diphosphonic acids, 1-hydroxyethane-1,1-diphosphonic acid, 1-phosphonoethane-1,2-dicarboxylic acid, 2-phosphonobutane-1,2,4-tricarboxylic acid and, more particularly, the hexasodium salt of ethylene diaminotetramethylene phosphonic acid.

The granulate is produced from the above-mentioned active ingredients by spraying the liquid or liquefied or dissolved active ingredients, i.e. the nonionic tenside and, optionally, the heavy metal complexing agents dissolved in water onto the solids, i.e. onto the activator for per compounds and the surface-active nitrogen-containing compound such as the quaternary ammonium compound, to which highly disperse silica as powdery carrier for the liquid or pasty active ingredients and granulate disintegrating agents may optionally have been added. One disintegrating agent suitable for use as part of the granulate is, for example, swellable magnesium aluminum silicate, such as Hectorite.

The granulate preferably contains from 1 to 5% by weight of the disintegrating agent and from 5 to 20% by weight of carrier, based in each case on the granulate without its protective coating.

In order to obtain tablets with the necessary strength at the tabletting stage and to prevent the nonionic tenside and, optionally, the other active ingredients from the granulate during tabletting, the granulate particles are coated with a protective layer. To this end, the granulate is powdered with the above-mentioned finely divided inert material and/or with the finely divided adsorbent, after which the granulate thus powdered is sprayed with a liquid binder, such as an aqueous sugar solution, more particularly a cane sugar or sorbitol solution, and subsequently dried. The granulate contains approximately 50 to 90% by weight of wash-active ingredients, the remainder consisting of tabletting auxiliaries. The powder density of the granulate sifted through a 2 mm mesh sieve amounts to between 600 and 700 g per liter.

The granulate coated with a protective layer and dried is preferably mixed with from 10 to 20% by weight, based on the granulate, of a tablet disintegrating agent, preferably a mixture of two different tablet disintegrating agents, more especially a mixture of cross-linked polyvinyl pyrrolidone and/or cellulose ethers and/or swellable magnesium aluminum silicate. The effect of a single tablet disintegrating agent may be enhanced by the addition of up to 7% by weight (based on the weight of the tablet) of an alkali metal salt of short-chain organic mono- or polycarboxylic acids, for example sodium acetate or sodium citrate. In the case of the preferred addition of a tablet disintegrating agent mixture containing polyvinyl pyrrolidone, a ratio by weight of polyvinyl pyrrolidone to the second tablet disintegrating agent of from 8:1 to 2:1 is particularly preferred.

The tablets are produced by forming tablets having a diameter of more than 30 mm and a depth of 0.75 to 1.1 times their diameter, but at least 25 mm. a density of from 0.8 to 1.2 g/$cm^3$ and a breaking strength of from 6 to 12 kg from the dried granulate under a pressure of from 500 to 1000 kp/$cm^2$.

Tabletting of the granulate may be carried out using known tabletting machines of the eccentric or rotary type providing they are able to achieve a compression ratio of from about 2.2:1 to 1.8:1 for tablets having the above-mentioned dimensions. The tablets which weigh from 15 to 50 g contain approximately 10 to 30 g of active ingredients in the following quantitative ratios: from 2 to 30 parts by weight of nonionic tenside, from 0.5 to 20 parts by weight of quaternary ammonium compound and/or fatty amine derivative and/or compounds corresponding to the formula R—N-H—$CH_2$—$CH_2$—COONa, from 2 to 30 parts by weight of activator for per compounds, from 0 to 5 parts by weight of heavy metal complexing agents, from 0 to 5 parts by weight of foam regulators.

The following examples are illustrative of the practice of the invention without being limitative in any manner.

EXAMPLES

EXAMPLE 1

In a 130-liter Loedige mixer, 5.16 kg of tetraacetyl ethylenediamine, 1.9 kg of tetradecyl trimethylammonium bromide, 2.2 kg of highly dispersed precipitated silica and 0.4 kg of magnesium aluminum silicate were sprayed while being continuously mixed with a liquid mixture of 5.16 kg of $C_{14}$–$C_{15}$ oxoalcohol adducted with 7 mols of ethylene oxide, 1.3 kg of a 33% by weight aqueous solution of the hexasodium salt of ethylenediamine tetramethylene phosphonic acid and 0.26 kg of a foam-inhibiting silicone oil. After mixing for 30 seconds, a uniform granulate which felt "greasy" was obtained. 0.9 kg of the highly dispersed precipitated silica and 1.08 kg of finely divided potato starch were then added with continued mixing. The granulate was surface-coated in this way. 1.62 kg of an aqueous 70% by weight sorbitol solution was then sprayed onto the granulate which was then dried for 3 minutes in air at 50° to 60° C. The water content of the granulate was 5% by weight.

The dried granulate was then carefully mixed with polyvinyl pyrrolidone (PVP) and sodium carboxymethyl cellulose (CMC) as disintegrating agents in such a quantity that there were 15 parts by weight of PVP and 5 parts by weight of CMC to 80 parts by weight of granulate. This mixing process was carried out in a Patterson-Kelley-Cron Flow Blender. A coated granulate having a powder density of 535 g per liter was obtained.

35 mm tablets were made in an eccentric press with an uncoated polished tablet mold. The 29.5 mm thick tablets weighed 28.5 g and had a breaking strength of 10 kg which was determined as follows:

In a Chatillon Tension and Compression Tester, the tablet was placed on a cavity block with a cavity somewhat smaller than the diameter of the tablet. The cavity block was moved by motive force on an anvil against a dynamometer with a wedge-shaped cutting edge. The movement was continued until the tablet broke. The force read off on breakage of the tablet is the breaking strength in kg. This method of determining breaking strength is described in detail in W. A. Ritschel's book entitled "Die Tablette", Edition Cantor KG, Aulendorf in Wuerttemberg, 1960, pages 312 and 313.

The tablets obtained dissolved completely in 6 minutes in a 30° C. wash (carried out in a Miele type 430 automatic washing machine). Despite two thirds of the recommended dosage of an inexpensive detergent, the soiled laundry washed in the presence of the tablets was distinctly cleaner than laundry washed without a detergency-boosting tablet.

EXAMPLE 2

When the dried granulate of Example 1 was used in a quantity of 85 parts by weight and mixed with 10 parts by weight of polyvinyl pyrrolidone and 5 parts by weight of swellable magnesium aluminum silicate, 30 g tablets having a breaking strength of approx. 8 kg were obtained from the granulate (powder density approx. 600 g per liter). After 10 minutes, these tablets had dissolved completely in the washing machine.

EXAMPLE 3

When, as in the preceding Examples, 83 parts by weight of dried granulate were mixed with 12 parts by weight of polyvinyl pyrrolidone and 5 parts by weight of anhydrous sodium acetate, a product having a powder density of 580 g per liter was obtained. After tabletting in a coated mold, this product gave 27.5 g tablets having a breaking strength of 10 kg which dissolved completely in 5 minutes in the washing machine.

The preceding specific embodiments are illustrative of the practice of the invention. It is to be understood however, that other expedients known to those skilled in the art or disclosed herein may be employed without departing from the spirit of the invention or the scope of the appended claims.

We claim:

1. A process for the production of a washion additive in tablet form containing on a weight basis of said tablet (1) 2 to 30% of at least one activator for per compounds (2) 2 to 30% of at least one nonionic surface-active compound, (3) 0.5 to 20% of at least one surface-active nitrogen-containing compound selected from the group consisting of quaternary ammonium compounds, fatty amine compounds, aminopropionic acid compounds, and mixtures thereof, (4) 0 to 5% of at least one water-soluble salt of an alkane polyphosphonic acid, and (5) 0 to 5% of at least one foam regulator, as wash-active ingredients, comprising the steps of:

A. granulating component (1) while simultaneously mixing therewith components (2) and (3) as well as components (4) and (5) if present, together with tabletting aids;

B. powdering the resulting granulate with a powder-form adsorbent;

C. spraying the powdered granulate with a liquid binder, said liquid binder being a solution of cane sugar or sorbitol;

D. drying the granulate to a water content of not more than 6% by weight to form a free-flowing granulate;

E. mixing the dried granulate with at least one tablet disintegrating agent; and F. compressing the granulate into tablets of more than 30 mm in diameter and having a depth of 0.75 to 1.1 times their diameter but said depth being at least 25 mm, a density of from 0.8 to 1.2 g/$cm^3$, a weight of from 15 to 50g, and a breaking strength of from 6 to 12 kg, whereby the tablets contain sufficient detergency-boosting ingredients for one load of washing.

2. The process of claim 1 wherein, before said granulate is formed, from 1 to 5% by weight, base on the granulate without its protective layer, of a granulate disintegrating agent is added.

3. The process of claim 1 wherein in step E. from 10 to 20% by weight, based on the final mixture before tabletting of at least one tablet disintegrating agent is added to said dried granulate before tabletting.

4. The process of claim 3 wherein a mixture of at least two different tablet disintegrating agents are added.

5. The process of claim 4 wherein said tablet disintegrating agents are selected from the group consisting of crosslinked polyvinyl pyrrolidone, cellulose ethers and swellable magnesium aluminum silicate.

6. The process of claim 5 wherein, where two different disintegrating agents are mixed, crosslinked polyvinyl pyrrolidone is added in admixture with cellulose ethers and/or swellable magnesium aluminum silicate in a ratio by weight of from 8:1 to 2:1.

7. The process of claim 1 wherein said activator for per compounds is an N-acyl or O-acyl compound, said nonionic surface-active compound is a $C_{12}$–$C_{18}$ alkanol ethoxylate, said surface-active nitrogen-containing compound is selected from the group consisting of quaternary ammonium compounds containing a $C_{10}$–$C_{20}$ alkyl or alkenyl radical and, for the rest, $C_1$–$C_4$ alkyl radicals, adducts of from 1 to 6 mols of ethylene oxide onto 1 mol of a primary fatty amine containing a $C_{10}$–$C_{16}$ alkyl or alkenyl radical and the sodium salt of $\beta$-aminoalkyl or alkenyl propionic acid corresponding to the formula $R—NH—CH_2—CH_2—COONa$, in which R is a $C_{10}$–$C_{16}$ alkyl or alkenyl radical.

8. The process of claim 1 wherein said at least one water-soluble salt of an alkane polyphosphonic acid is present.

9. The process of claim 1 wherein said at least one foam regulator is present and is foam inhibitor.

10. The process of claim 1 wherein said tabletting aids in said granulation step A. are one or more water-insoluble or water-soluble powdery carriers for liquid or pasty wash-active ingredients.

11. The process of claim 7 wherein said $C_{12}$–$C_{18}$ alkanol ethoxylate is a $C_{14}$–$C_{15}$ oxoalcohol ethoxylated with about 7 mols of ethylene oxide per mol of alcohol.

12. The process of claim 7 wherein said quaternary ammonium compound is tetradecyl trimethylammonium bromide.

13. The process of claim 8 wherein said alkane polyphosphonic acid is an alkali-metal salt of an acid selected from the group consisting of phosphonoalkane polyphosphonic acids and amino- and hydroxy-substituted alkane polyphosphonic acids.

14. The process of claim 13 wherein said alkali-metal salt of an acid is an acid selected from the group consisting of amino-tris-(methylenephosphonic acid), dimethylamino-methane disphosponic acids, 1-hydroxyethane-1, 1-disphosphonic acid, 1-phosphonoethane-1, 2-dicarboxylic acid, 2-phosphonobutane-1, 2, 4-tricarboxylic acid and, ethylenediamine tetramethylene, phosphonic acid.

15. The process of claim 14 wherein said alkali metal salt of an acid is the hexasodium salt of ethylenediamine tetramethylene phosphonic acid.

* * * * *